United States Patent [19]

Snell

[11] 4,077,881

[45] Mar. 7, 1978

[54] SEPARATION OF INSOLUBLE MATERIAL FROM COAL LIQUEFACTION PRODUCT BY GRAVITY SETTLING

[75] Inventor: George J. Snell, Fords, N.J.

[73] Assignee: The Lummus Company, Bloomfield, N.J.

[21] Appl. No.: 703,671

[22] Filed: Jul. 8, 1976

[51] Int. Cl.[2] ..... B01D 21/02

[52] U.S. Cl. ..... 210/83; 208/8

[58] Field of Search ..... 210/73 R, 83, 513, 74, 210/194, 197; 208/8, 10, 180

[56] References Cited

U.S. PATENT DOCUMENTS 3,520,794 7/1970 Gatsis ..... 208/8

3,856,675 12/1974 Sze et al. ..... 210/73 R 3,954,595 5/1976 Sze et al. ..... 208/8

FOREIGN PATENT DOCUMENTS 1,282,917 12/1961 France ..... 210/197

*Primary Examiner*—William A. Cuchlinski, Jr.

*Attorney, Agent, or Firm*—Marn & Jangarathis

[57] ABSTRACT

Insoluble material is separated from a coal liquefaction product by gravity settling in the presence of a promoter liquid having specific characteristics, with a portion of the solid containing underflow being recycled to the gravity settler and introduced at a point above the introduction of the coal liquefaction product, with the respective points of introduction being separated by a distance of at least 0.1 H and no greater than 0.5 H wherein H is the total height of the gravity settler.

4 Claims, 1 Drawing Figure

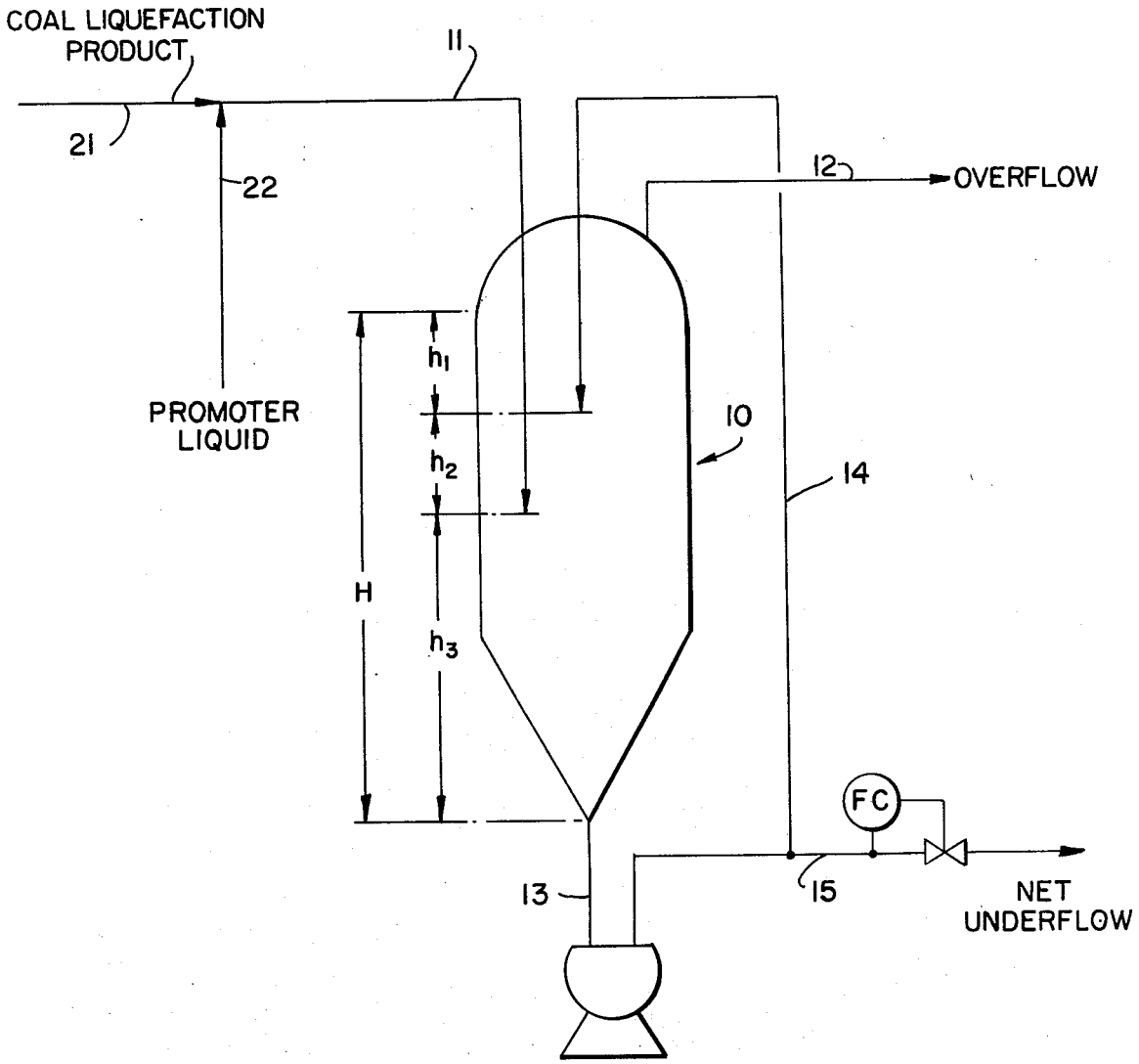
COAL LIQUEFACTION PRODUCT
11
21
22
12
OVERFLOW
PROMOTER LIQUID
$h_1$
$h_2$
$h_3$
H
10
14
FC
13
15
NET UNDERFLOW

SEPARATION OF INSOLUBLE MATERIAL FROM COAL LIQUEFACTION PRODUCT BY GRAVITY SETTLING

This invention relates to liquefaction of coal, and more particularly, to the separation of insoluble material from a coal liquefaction product by gravity settling.

Coal can be converted to valuable products by subjecting coal to solvent extraction, with or without hydrogen, to produce a mixture of coal extract and undissolved coal residue, including undissolved extractable carbonaceous matter, fusain and mineral matter or ash.

In U.S. Pat. No. 3,856,675, there is disclosed an improved process for separating insoluble material from a coal liquefaction product wherein such insoluble material is separated by gravity settling in the presence of a promoter liquid having specific characteristics. The present invention is directed to providing for improved separation of such insoluble material by gravity settling in the presence of a promotor liquid, as described in U.S. Pat. No. 3,856,675.

In accordance with the present invention, there is provided a process for separating insoluble material from a coal liquefaction product produced from a coal feed and comprised of insoluble material and carbonaceous matter dissolved in a coal liquefaction solvent by gravity settling in the presence of a liquid promoter which promotes and enhances the separation of the insoluble material wherein a portion of the solid containing underflow is recycled to the gravity settler and introduced into the gravity settler at a point above the introduction of the mixture of coal liquefaction product and promoter liquid, with the respective introduction points being separated in the vertical direction by a distance of at least 0.1 H and no greater than 0.5 H, wherein H is the total height of the gravity settler.

More particularly, the mixture of promoter liquid and coal liquefaction product is introduced into an intermediate portion of the gravity settler, and in the gravity settler, there is recovered an essentially solid free overflow, and a solid containing underflow. A portion of the solids containing underflow is recycled to the gravity settler, with such recycle being introduced into the gravity settler at a point above the introduction point of the mixture of promoter liquid and coal liquefaction product, with the respective points of introduction being separated by a distance of at least 0.1 H and no greater than 0.5 H, wherein H is the total height of the gravity settler, with the circulating underflow stream generally being recycled in an amount to provide a weight ratio of the recycled underflow to the mixture of coal liquefaction product and promoter liquid of from about 0.5:1 to 10.0:1, and preferably from about 0.5:1 to about 5.0:1. In general, the underflow recycle is introduced into the gravity settler at a distance below the top of the gravity settler which is at least 0.2 H and no greater than about 0.5 H. Similarly, the mixture of promoter liquid and coal liquefaction product is introduced into the gravity settler at a distance above the bottom of the gravity settler which is at least about 0.3 H and no greater than about 0.6 H. In general, the height (H) of the gravity settler is from about 0.25D to about 10D, where D is the diameter of the gravity settler for the base of a cylindrical settler.

The gravity settling is generally effected at temperatures from about 300° F to about 600° F, preferably from about 350° F to about 500° F, and a pressure from about 0 psig to about 500 psig, preferably at a pressure from about 0 psig to about 300 psig. It is to be understood, however, that higher pressures could be employed, but as should be apparent to those skilled in the art, lower pressures are preferred. The net underflow is withdrawn from the gravity settler at a rate of from about 10 to about 50 weight percent, preferably from about 15 to about 45 weight percent, of the total net feed to the gravity settler. In general, the residence time of such settling is in the order of from about 0.1 to about 10.0 hours based on total net feed.

The coal liquefaction product is introduced into the gravity settler in admixture with a promoter liquid, as net feed, with the promoter liquid having the properties described in U.S. Pat. No. 3,856,675. As described in the aforementioned patent, the promoter liquid is one that has an aromaticity less than that of the liquefaction solvent and is generally a hydrocarbon liquid having a characterization factor (K) of at least about 9.75 and preferably at least about 11.0, with such characterization factor being an index of the aromaticity/-parafinicity of hydrocarbons and petroleum fractions as disclosed by Watson and Nelson, Ind. Eng. Chem. 25 880 (1933). The liquid which is used to enhance and promote the separation of insoluble material is further characterized by a 5 volume percent distillation temperature of at least about 250° F and a 95 volume percent distillation temperature of at least about 350° F and no greater than about 750° F. The promoter liquid preferably has a 5 volume percent distillation temperature of at least about 310° F and most preferably of at least about 400° F. The 95 volume percent distillation temperature is preferably no greater than about 600° F. The most preferred promoter liquid has a 5 volume percent distillation temperature of at least about 425° F and a 95 volume percent distillation temperature of no greater than about 500° F.

As representative examples of such liquids, there may be mentioned: kerosene or kerosene fraction from paraffinic or mixed base crude oils; middle distillates, light gas oils and gas oil fractions from paraffinic or mixed based crude oils; alkyl benzenes with side chains containing 10 or more carbon atoms; paraffinic hydrocarbons containing more than 12 carbon atoms; white oils or white oil fraction derived from crude oils; alpha-olefins containing more than 12 carbon atoms; fully hydrogenated naphthalenes and substituted naphthalenes; propylene oligomers (pentamer and higher); tetrahydronaphthalene, heavy naphtha fractions, etc. The most preferred liquids are kerosene fractions; white oils; fully hydrogenated naphthalenes and substituted naphthalenes.

The amount of liquid promoter used for enhancing and promoting the separation of insoluble matter from the coal liquefaction product will vary with the particular liquid employed, the coal liquefaction solvent, the coal used as starting material and the manner in which the liquefaction is effected. As should be apparent to those skilled in the art, the amount of liquid promoter used should be minimized in order to reduce the overall costs of the process. It has been found that by using the liquid of controlled aromaticity, the desired separation of insoluble material may be effected with modest amounts of liquid promoter. In general, the weight ratio of liquid promoter to coal solution may range from about 0.2:1 to about 3.0:1, preferably from about 0.3:1 to about 1.5:1. In using the preferred promoter liquid of the present invention which is a kerosene fraction having 5 percent and 95 percent volume distillation temperatures of 425° and 500° F respectively, promoter liquid to coal solution weight ratios in the order of 0.4:1 and 0.6:1 have been particularly successful. It is to be understood, however, that greater amounts of liquid promoter may be employed, but the use of such greater amounts is uneconomical. In addition, the use of an excess of liquid promoter may result in the precipitation or separation of an excessive amount of desired coal derived products from the coal extract. More particularly, as the amount of liquid promoter employed is increased, a greater amount of ash is separated from the coal solution, but such an increased separation is accompanied by an increased separation of desired coal derived products from the coal solution. The net coal product (the extracted carbonaceous matter, excluding promoter liquid, liquefaction solvent and gas make) contains less than about 1% insoluble material, generally less than 0.1% insoluble material, and most preferably less than 0.05% insoluble material, all by weight.

The invention will be further described with respect to the accompanying drawing wherein:

The drawing is a simplified schematic representation of an embodiment of a gravity settler in accordance with the present invention.

Referring now to the drawing, there is shown a gravity settler, schematically indicated as 10 which includes an inlet pipe 11 for introduction of net feed, an overflow pipe 12 for withdrawing essentially solid free overflow, an underflow outlet pipe 13 for withdrawing the solid containing underflow and a recycle inlet pipe 14 for recycle of a portion of the solids containing underflow.

The net feed introduced into the gravity settler 10 through line 11 is a coal liquefaction product comprised of insoluble material and carbonaceous matter dissolved in a coal liquefaction solvent, in line 21, which is admixed with a promoter liquid in line 22 having the hereinabove described properties. The coal liquefaction product is produced from ground or pulverized coal, generally bituminous, sub-bituminous or lignite by coal solvation, as known in the art. In general, such coal solvation is effected by dissolving the coal in a coal liquefaction solvent, of a type used in the art, including both hydrogen donor solvents, nonhydrogen donor solvents and mixtures thereof, with such dissolution being effected in the presence or absence of added hydrogen and in the presence or absence of a suitable catalyst. The procedures or producing such a coal liquefaction product are well known in the art, and no further details in this respect are needed for a complete understanding of the present invention.

The fresh feed is introduced into the gravity settler through line 11 at a height above the bottom of the gravity settler which is designated as $h_3$, wherein $h_3$ is at least 0.3 H and no greater than 0.6 H, wherein H is the overall height of the gravity settler, as indicated.

In the gravity settler 10, the net feed is separated into an essentially solid free overflow, which is withdrawn through line 12 for recovery of promoter liquid and the various components, as a net product, and a solids containing underflow, which is withdrawn from the gravity settler through line 13. As particularly shown, the lower portion of the gravity settler includes a conically shaped baffle to prevent short circuiting of the net feed to the gravity settler outlet; however, as should be apparent to those skilled in the art, the use of such a conically shaped baffle is optional and may be omitted.

The solids containing underflow is withdrawn from the gravity settler through line 13 and a portion thereof is recycled to the gravity settler through line 14. A net underflow product is recovered through line 15.

The recycled underflow is introduced into the gravity settler, through line 14, at a point which is at a distance $h_1$ below the top of the gravity settler, with $h_1$ being at least 0.2 H and no greater than 0.5 H. Moreover, the recycle underflow is introduced through line 14 at a distance $h_2$ above the point of introduction of the net feed, with $h_2$ being at least 0.1 H and no greater than 0.5 H.

As hereinabove noted, the weight ratio of the recycle introduced through line 14 to the net feed introduced through line 11 is generally from about 0.5 to about 10.0, and most preferably from about 0.5 to from 5.0.

The invention will be further described with respect to the following examples; however, it is to be understood that the present invention is not to be limited thereby.

EXAMPLE 1

The following summarizes the feedstock data for the feedstock employed in this Example.

| Deashing Feedstock Inspection Data Summary | |
|---|---|
| Specific Gravity at 250° F/60° F (ASTM D-287), wt.% | 1.07 |
| Ash Content (ASTM D-482), wt. % | 3.53 |
| Quinoline Insolubles Content (ASTM D-2318-66), wt. % | 5.29 |
| Benzene Insolubles Content (ASTM D-367-67), wt. % | 8.46 |
| Vacuum Distillation (+800° F) Residue Content (ASTM D-1160-61), wt. % | 28.84 |

The gravity settler employed in this Example has an inside diameter of 10 inches, an overall height H of 41 inches, with $h_1 = 10$ inches, $h_2 = 10$ inches and $h_3 = 41$ inches.

Gravity settling is effected for 30 hours at 550° F with promoter liquid ($K = 11.0 \pm 0.1$) being fed (line 22) at a rate of 22 lbs/hr; and liquefaction product (line 21) at 59 lbs/hr (total feed in line 11 is 81 lbs/hr). Overflow (line 12) is withdrawn at a rate of 54 lbs/hr; net underflow (line 15) 27 lbs/hr and recycle (line 14) 53 lbs/hr.

The composite overflow product has an ash content of 0.03 wt. % which is 99.2% degree of ash removal based on feedstock.

EXAMPLE 2

The feedstock, promoter liquid and gravity settler are identical to Example 1, except there is no underflow recycle. Gravity settling is effected for a period of 38 hours at 550° F.

Promoter liquid (line 22) is fed at a rate of 13 lbs/hr, and coal liquefaction product feed (line 21) at 35 lbs/hr. Overflow (line 12) is withdrawn at a rate of 32 lbs/hr and net underflow (lines 13 and 15) at a rate of 16 lbs/hr.

The composite overflow has an ash content of 0.10 wt. % which is 97.41% degree of ash removal, based on feedstock.

Thus, by proceeding in accordance with the present invention it is possible to both increase throughput and improve ash removal. It would normally be expected that in a gravity settling operation an increase in throughput would decrease the degree of ash removal.

Numerous modifications and variations of the present invention are possible in light of the above teachings and, therefore, within the scope of the appended claims, the invention may be practiced otherwise than as particularly described.

What is claimed is:

1. In a process for separating insoluble material from a coal liquefaction product comprised of insoluble material and carbonaceous matter dissolved in a coal liquefaction solvent in a gravity settler in the presence of a promoter liquid having a 5 volume percent distillation temperature of at least about 250° F and a 95 volume percent distillation temperature of at least about 350° F and no greater than about 750° F, said promoter liquid having a characterization factor greater than said coal liquefaction solvent and said characterization factor being at least 9.75, the improvement comprising:

introducing a feed mixture of said coal liquefaction product and said promoter liquid into said gravity settler;

withdrawing an essentially solids free overflow from said gravity settler;

withdrawing a solids containing underflow from said gravity settler;

recycling a portion of said solids containing underflow to said gravity settler at a rate to provide a recycled underflow to feed mixture weight ratio of from about 0.5:1 to 10:1, said solids containing underflow being introduced into the gravity settler above the point at which said mixture of said coal liquefaction product and said promoter liquid are introduced into said gravity settler, said points of introduction of said mixture and said solids containing underflow being separated by a vertical distance of at least 0.1 H and no greater than 0.5 H wherein H is the total height of the gravity settler; and recovering a net solids containing underflow.

2. The process of claim 1 wherein said solids containing underflow is introduced into said gravity settler at a distance below the top thereof which is at least 0.2 H and no greater than 0.5 H and said mixture of promoter liquid and said coal liquefaction product is introduced into said gravity settler at a distance above the bottom of the gravity settler which is at least 0.3 H and no greater than 0.6 H.

3. The process of claim 2 wherein the recycle underflow to feed material weight ratio is from about 0.5:1 to 5.0:1.

4. The process of claim 3 wherein the net solids containing underflow is recovered at a rate of from 10 to 50 weight percent of the feed mixture introduction.

* * * * *